US006257671B1

(12) United States Patent
Siebenhofer et al.

(10) Patent No.: US 6,257,671 B1
(45) Date of Patent: Jul. 10, 2001

(54) DEVICE FOR PROTECTING SELECTIVE CUTTING MACHINES AGAINST OVERLOAD

(75) Inventors: Gottfried Siebenhofer, Fohnsdorf; Walter Leitner, Zeltweg; Nikolaus Sifferlinger, St. Stefan, all of (AT)

(73) Assignee: Tamrock Voest-Alpine Bergtechnik Gesellschaft m.b.H., Zeltweg (AT)

( * ) Notice: Subject to any disclaimer, the term of this patent is extended or adjusted under 35 U.S.C. 154(b) by 0 days.

(21) Appl. No.: 09/407,962

(22) Filed: Sep. 29, 1999

(51) Int. Cl.[7] ..... E21C 27/24
(52) U.S. Cl. ..... 299/1.6; 299/34.01
(58) Field of Search ..... 299/1.6, 1.2, 34.01, 299/34.02, 80.1

(56) References Cited

U.S. PATENT DOCUMENTS 4,189,183 * 2/1980 Borowski ..... 299/1.6
4,368,919 1/1983 Whittaker et al. .
4,470,635 9/1984 Paurat et al. .
4,642,017 * 2/1987 Fenn ..... 414/348
4,653,159 * 3/1987 Henderson et al. ..... 29/33 M
4,655,082 4/1987 Peterson .

FOREIGN PATENT DOCUMENTS 28 42 963 4/1980 (DE) .

* cited by examiner

*Primary Examiner*—Frank Tsay
(74) *Attorney, Agent, or Firm*—Pillsbury Winthrop LLP

(57) ABSTRACT

The invention relates to a device for protecting selective cutting machines against overload, in which the selective cutting machine has cutting tools, in particular cutting rollers, rotatably supported on a pivotable cantilevered arm, and both the cutting tools and the cutting arm are connected to separate drive mechanisms. At least one strain or deformation measuring sensor is disposed on the pivotable cantilevered arm, and its signals are delivered to an evaluation circuit; the evaluation circuit is connected via control lines at least to the drive mechanisms of the cutting arm and the cutting tool.

10 Claims, 3 Drawing Sheets

DEVICE FOR PROTECTING SELECTIVE CUTTING MACHINES AGAINST OVERLOAD

BACKGROUND OF THE INVENTION

1. Field of the Invention

The invention relates to a device for protecting selective cutting machines against overload, in which the selective cutting machine has cutting tools, in particular cutting rollers, rotatably supported on a pivotable cantilevered arm, and the cutting tools and the cutting arm are connected to separate drive mechanisms.

2. Prior Art

Selective cutting machines, having cantilevered arms that are pivotable about at least two axes, as a rule have either cutting heads or cutting rollers. In the case of cutting heads, such cutting heads are usually designed for a particular pivoting speed of the cutting arm, so as to obtain a correct cutting pattern for a predetermined pressure resistance of a test cube on the part of the rock to be worked. Any deviation in pivoting speed from the pivoting speed for which the arrangement of cutters on the cutting head was designed can lead to severe vibrations, which can lead to the breakage of parts and especially of the cutters. Such impermissible vibrations have been detected in accordance with the proposal in German Patent Disclosure DE 33 43 372 A1 by a vibration sensor, and its signals have been evaluated and used for closed-loop control of the drive mechanism of the cutting speed.

However, above all in roller cutting machines, impermissible stresses and overloads are of particular importance, and such stresses cannot be detected correctly by vibration sensors. In roller cutting machines, a relatively wide roller is rotatably supported on the free end of the cutting arm; on pivoting of the cantilevered arm or cutting arm about a substantially vertical axis, the cutting forces act on the cutting or cantilevered arm via a long lever arm. When materials are being worked, it often happens that regions of less hardness or toughness or that are highly brittle are penetrated, and in these regions even large pivoting angles of the cutting arm have still not led to excessive loads, because the material can readily be cut or broken. However, if in certain pivoted positions a higher pressure resistance to a test cube is exerted on material, the result is impermissible stresses, which can cause heavy damage to the machine.

For monitoring impermissible operating states in roller cutting machines, it has previously been proposed that monitoring devices be used, in which the temperature of the liquid circulation of the hydraulic winch, the temperature of certain bearing points, the temperature of the coolant circulation, or the pressure as well has been monitored. Such monitoring devices are described for instance in German Patent Disclosure DE-OS 29 17 054. In German Patent Disclosures DE-OS 31 00 116 and DE-OS 31 06 348, special cutting tools can be found in which a cutting characteristic of the particular rock or mineral can be sampled during cutting by the cutting tool. Such devices are relatively complicated and expensive, because they have to be disposed in the immediate vicinity of the cutters acted upon by the cutting pressure, and the bearing points for pivoting the cutters are subject to correspondingly high wear.

SUMMARY OF THE INVENTION

It is now the object of the invention to create a device of the type defined at the outset, in particular for selective cutting machines with wide cutting rollers, with which device impermissible operating states and any possible overload are detected in a simple and reliable way, so that the risk of permanent deformation of parts of the drive mechanism or even of the cantilevered arm itself can be reliably averted. To attain this object, the especially simple, operationally reliable embodiment according to the invention of the device defined at the outset is characterized substantially in that at least one strain or deformation measuring sensor is disposed on the pivotable cantilevered arm, and its signals are delivered to an evaluation circuit; and that the evaluation circuit is connected at least to the drive mechanisms of the cutting arm and of the cutting tool via control lines. Because only a strain or deformation measuring sensor is disposed on the pivotable cantilevered arm, the effective deformation forces on the cantilevered arm, of the kind that have been observed especially with an eccentric load and in machines with wide cutting rollers when the cantilevered arm is pivoted, can be detected especially simply and reliably, and a suitable open- or closed-loop control of the drive mechanism of the cutting arm or cutting tool can be achieved. With the disposition of the sensor on the cantilevered arm, overloads of such components as bearings, carriages or slideways, which are especially threatened in the presence of severe eccentric loads, can be averted by the suitable open- or closed-loop control of the drive mechanism of the cutting arm or cutting tool.

Especially advantageously, the embodiment according to the invention is further embodied such that the evaluation circuit is additionally connected to the running gear drive mechanism, in particular a track-type running gear drive mechanism, of a traveling selective cutting machine. In roller cutting machines, different operating states, in each of which only some of the various drive mechanisms are simultaneously supplied with energy, are defined exactly. Depending on the operating state, with the device of the invention the requisite open- or closed-loop control provisions can be initiated especially simply.

An especially reliable detection of impermissible forces and thus a reliable detection of any possible overload can be attained in that the sensor is disposed in or on a housing wall of the cantilevered arm.

To enable taking the different operating states of roller cutting machines into account completely and optimally, the embodiment is advantageously such that the drive mechanisms of the selective cutting machine are connected to the evaluation circuit via reporting lines for the operation of the applicable drive mechanism. In this way, all the necessary information is available to the evaluation circuit for affecting actually those particular drive mechanisms with which the possible overload can be reliably averted, with the least possible reduction in cutting or breaking capacity. To that end, the embodiment is advantageously such that the operation of a drive mechanism, signaled via the reporting line, for controlling the applicable drive mechanism to be triggered to avoid an overload is evaluated in the evaluation circuit.

For various operating states, the procedure is advantageously such that the evaluation circuit, in penetration cutting, generates control signals for the drive mechanism of the cutter motor and the displacement drive mechanism, in particular the hydraulic displacement cylinder for the bearing of the pivot axis of a roller cutting machine, or that the evaluation circuit in cutting by a roller cutting device in the vertical direction (shearing), generates control signals for the drive mechanism of the cutter motor and for the pivot cylinder for the vertical pivoting of the cantilevered arm, or that when curves are being cut, control signals for the track-type running gear drive mechanism are generated in addition to the control signals for the cutter motor and the vertical pivoting cylinder. These special operating states, such as penetration cutting, so-called shearing, or curve cutting, can in this way be mastered reliably with only slight corrections and without the possibility of an overload.

Especially reliable detection and correspondingly clear signals of the strain or deformation measuring sensors can be obtained in that the sensor or sensors on the cantilevered arm are disposed closer to the pivot axis of the cantilevered arm and preferably in the one-third of the length of the cantilevered arm adjacent to the pivot axis; this arm is embodied as a box profile frame. In an especially simple way, the embodiment is such that the deformation sensors are embodied as strain measuring sensors or strain gauges fixed to a thin-walled carrier and the carrier plate is fixed to the outside of the cantilevered arm.

BRIEF DESCRIPTION OF THE DRAWINGS

The invention will be described in further detail below in conjunction with exemplary embodiments schematically shown in the drawing.

DETAILED DESCRIPTION OF PREFERRED EMBODIMENTS OF THE INVENTION

Figure 1:
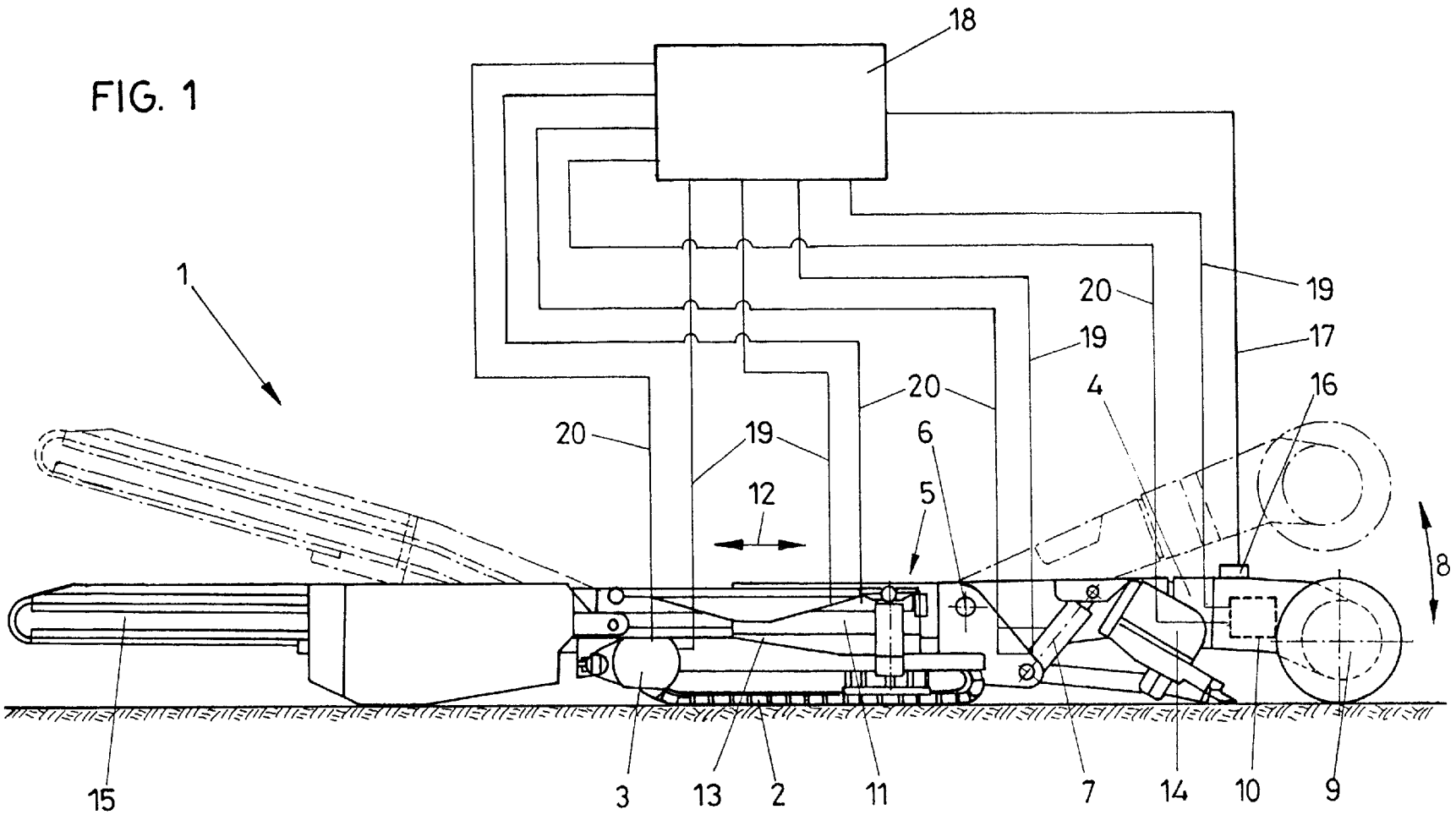
FIG. 1 shows a roller cutting machine in a side view with a schematically indicated evaluation circuit.

In FIG. 1, a roller cutting machine 1 is shown, which can travel on a track-type running gear 2; the drive mechanism of the track-type running gear is designated by reference numeral 3.

A cantilevered arm 4 is pivotably supported vertically on a carriage 5 about a substantially horizontal axis 6. The pivot drive mechanism for this vertical pivoting about the pivot axis 6 is designated by reference numeral 7 and is formed by a hydraulic cylinder-piston unit that is pivotably connected to the cutting arm 4. The cutting arm 4 carries rotatably supported cutting rollers 9. As the cutting drive mechanism 10 for the cutting rollers 9, a cutter motor is provided, disposed in the cantilevered arm 4. The carriage 5 is displaceable, via a displacement drive mechanism 11 embodied as a cylinder-piston unit, in the direction of the double arrow 12. On the machine frame 13, a loading device 14 and a discharge device 15 are also provided. On the cantilevered arm 4, there is also a strain or deformation measuring sensor, with which the effective deformation forces on the cantilevered arm 4, of the kind that occur particularly with an eccentric load, can be detected.

The deformation sensor 16 is connected via a signal line 17 to an evaluation circuit 18. Connected to this evaluation circuit 18, via respective reporting lines 19, are the track-type running gear drive mechanism 3, the pivot drive mechanism 7 for the cantilevered arm 4 of the displacement drive mechanism 11, and the holding drive mechanism 10 for the cutting rollers 9. Via these reporting lines 19, the evaluation circuit is supplied with signals upon operation of the various drive mechanisms 3, 7, 10 and 11. In the evaluation circuit 18, the signals, delivered via the signal line 17, of the strain or deformation measuring sensor 16, together with the signals delivered via the reporting lines 19 pertaining to the operational state of the track-type running gear drive mechanism 3, the pivot drive mechanism 7, the displacement drive mechanism 11, or pertaining to the holding drive mechanism 10 are processed, and control signals are generated that are delivered to the various drive mechanisms 3, 7, 10 or 11 via control lines 20. Open- and closed-loop control provisions for averting an overload of the various drive mechanisms 3, 7, 10 or 11 of the cutting machine 1 can thus be taken in a simple way, in accordance with the operating state.

Figure 2:
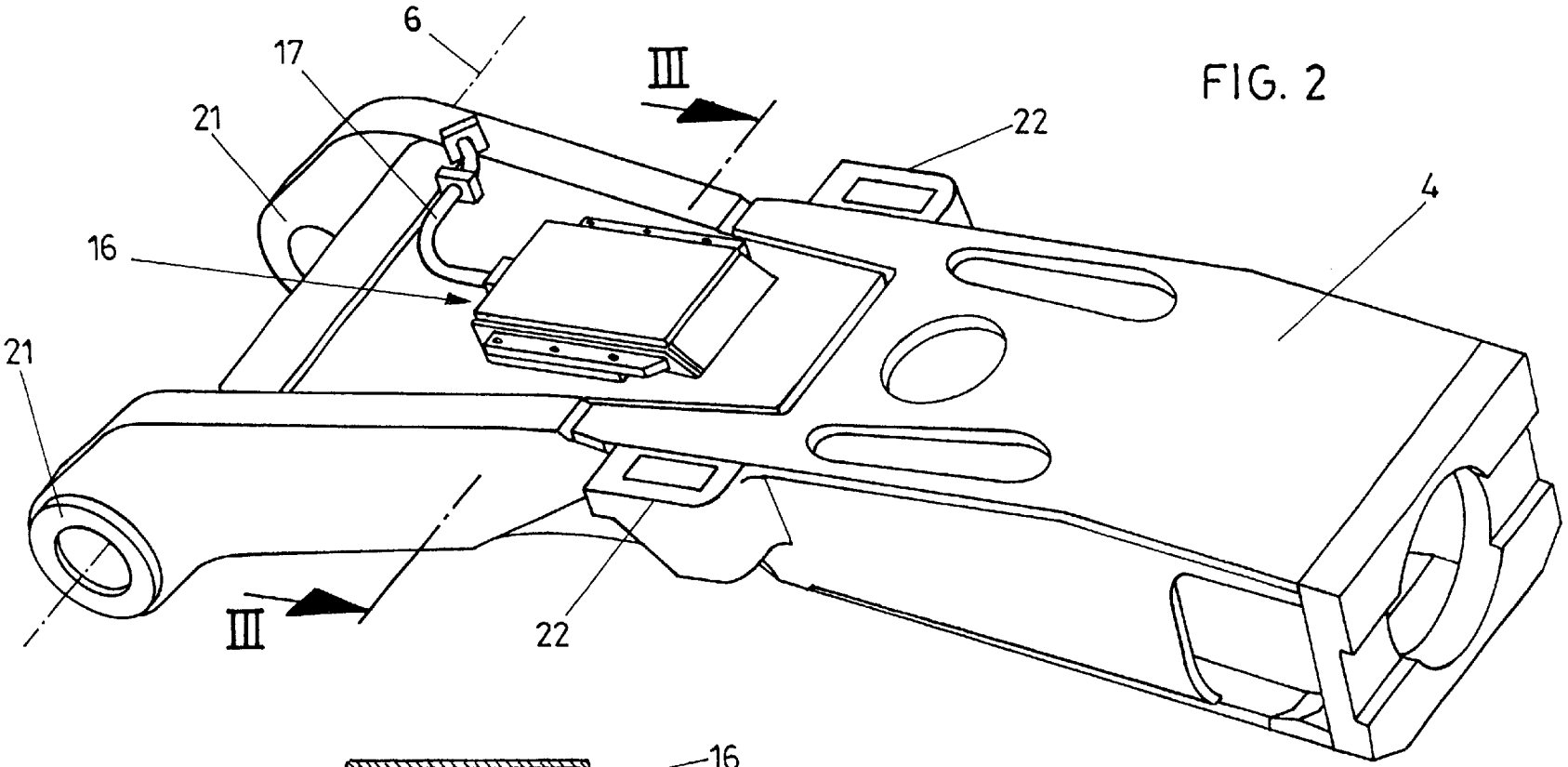
FIG. 2 is an elevation view of the cantilevered arm of a roller cutting machine in a perspective plan view.

In FIG. 2, the cantilevered arm 4 of the cutting machine described in FIG. 1 is shown in further detail in a perspective plan view. The cantilevered arm 4 has three bearing eyelets 21, on which the cantilevered arm 4 is pivotably supported on the carriage 5, of the cutting machine 1 shown in FIG. 1 about an axis 6. The cantilevered arm 4 also has tabs 22, to which the pivot drive mechanisms, not shown in detail in FIG. 2, can be secured in an articulated way. The deformation or strain measuring sensor 16, from which signal lines 17 lead away, is secured to the top side of the cantilevered arm 4, which is embodied as a box profile.

Figure 3:
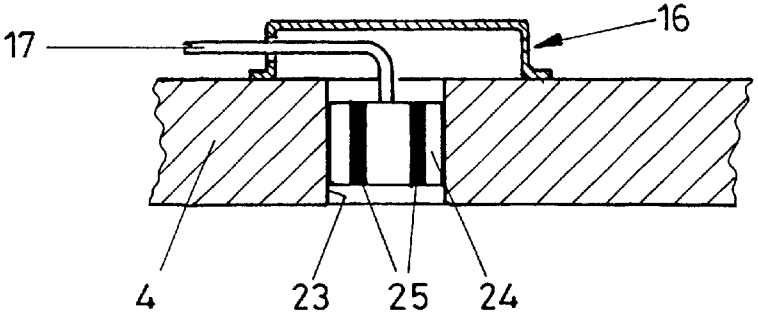
FIG. 3 is a section taken along the line III—III of FIG. 2 and shows a first embodiment of a strain measuring sensor.

FIG. 3 shows a section taken along the line III—III of FIG. 2 and shows one embodiment of the sensor 16. Here a bolt 24 having four strain gauges 25 disposed on its circumference, these gauges together with the bolt 24 forming the sensor 16, is press-fitted into a bore 23 in the top side of the cantilevered arm 4 embodied as a box profile. The overall result of the embodiment of the sensor 16 shown in FIG. 3 is a compact unit, which can be protected in a simple way from material falling from above.

Figure 4:
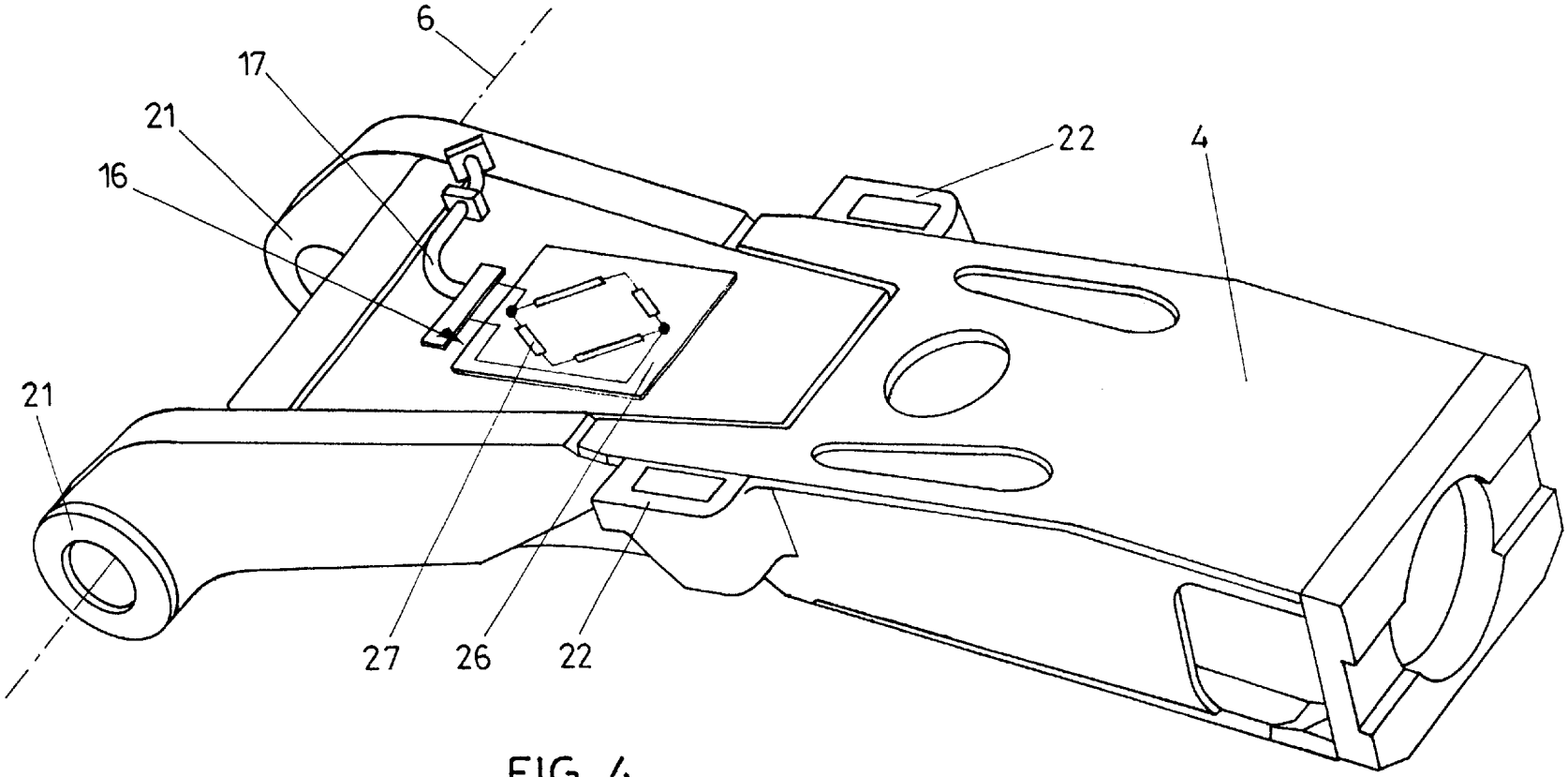
FIG. 4 shows an alternative embodiment to FIG. 3 of a strain measuring sensor.

In FIG. 4, an alternative embodiment of the strain or deformation measuring sensor 16 is shown. Strain gauges 27 in the form of a bridge circuit, which is again connected to the signal line 17, are disposed here on a thin-walled metal sheet 26, which in turn is secured to the top side of the cantilevered arm 4 embodied as a box profile. With this sensor arrangement as well, the strain of the cantilevered arm 4 can be used as a threshold value for limiting the forces that engage critical components, such as the bearings, slideways or carriages of the roller cutting machine, and thus an overload on these components can be precluded in a simple way.

What is claimed is:

1. A device for protecting selective cutting machines against overload, in which the selective cutting machine has cutting tools, in particular cutting rollers, rotatably supported on a pivotable cantilevered arm, and the cutting tools and the arm are connected to separate drive mechanisms, characterized in that at least one strain or deformation measuring sensor is disposed on the pivotable cantilevered arm, and its signals are delivered to an evaluation circuit; and that the evaluation circuit is connected at least to the drive mechanisms of the arm and of the cutting tool via control lines.

2. The device of claim 1, characterized in that the evaluation circuit is additionally connected to a running gear drive mechanism, in particular a track-type running gear drive mechanism, of a traveling selective cutting machine.

3. The device of claim 1 or 2, characterized in that the sensor is disposed in or on a housing wall of the cantilevered arm.

4. The device of claim 1, characterized in that the drive mechanisms of the selective cutting machine are connected to the evaluation circuit via reporting lines for monitoring the operation of the respective drive mechanisms.

5. The device of claim 1, characterized in that the operation of a drive mechanism, signaled via the reporting line so as to avoid an overload, is evaluated in the evaluation circuit.

6. The device of claim 1, characterized in that the evaluation circuit, in penetration cutting, generates control signals for the drive mechanism of a cutter motor and a displacement drive mechanism, in particular a hydraulic displacement cylinder.

7. The device of claim 1, characterized in that the evaluation circuit during cutting of a roller cutting device in the vertical direction, generates control signals for the drive mechanism of a cutter motor and for a pivot cylinder for vertical pivoting of the cantilevered arm.

8. The device of claim 6, characterized in that when curves are being cut, control signals for a track-type running gear drive mechanism are generated in addition to the control signals for the cutter motor and the displacement cylinder.

9. The device of claim 1, characterized in that the at least one sensor disposed on the cantilevered arm is disposed adjacent a pivot axis of the cantilevered arm, preferably in the first third of the length of the cantilevered ann.

10. The device of claim 1, characterized in that the at least one deformation sensor is embodied as a strain measuring sensor or strain gauge fixed to a thin-walled carrier, and a carrier plate is fixed to an outside surface of the cantilevered arm.

* * * * *